US009333403B2

(12) United States Patent
Deshmukh et al.

(10) Patent No.: US 9,333,403 B2
(45) Date of Patent: May 10, 2016

(54) HEAT TREATED GOLF CLUB

(71) Applicant: Acushnet Company, Fairhaven, MA (US)

(72) Inventors: Uday Deshmukh, Carlsbad, CA (US); Thomas Orrin Bennett, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 126 days.

(21) Appl. No.: 14/271,490

(22) Filed: May 7, 2014

(65) Prior Publication Data

US 2015/0321053 A1 Nov. 12, 2015

(51) Int. Cl.
*A63B 53/04* (2015.01)

(52) U.S. Cl.
CPC ..... *A63B 53/0466* (2013.01); *A63B 2053/0416* (2013.01); *Y10T 29/49828* (2015.01)

(58) Field of Classification Search
CPC ..... A63B 53/0466; A63B 2053/0416; Y10T 29/49828
USPC ..... 473/324–350, 287–292
See application file for complete search history.

(56) References Cited

U.S. PATENT DOCUMENTS

| | | | | |
|---|---|---|---|---|
| 2,332,342 | A | 10/1943 | Reach | |
| 5,451,056 | A * | 9/1995 | Manning | A63B 53/04 473/311 |
| 6,059,670 | A * | 5/2000 | Mogan | A63B 53/04 473/342 |
| 6,364,789 | B1 * | 4/2002 | Kosmatka | A63B 53/04 473/329 |
| 6,443,854 | B1 * | 9/2002 | Calboreanu | A63B 53/0466 428/650 |
| 6,979,270 | B1 * | 12/2005 | Allen | A63B 53/04 473/290 |
| 7,306,527 | B2 | 12/2007 | Williams et al. | |
| 8,075,420 | B2 | 12/2011 | Rick | |
| 8,500,573 | B2 | 8/2013 | Rick | |
| 8,663,029 | B2 | 3/2014 | Beach et al. | |
| 2002/0019265 | A1 * | 2/2002 | Allen | A63B 53/04 473/329 |
| 2004/0092333 | A1 * | 5/2004 | Deshmukh | A63B 53/04 473/342 |
| 2005/0282658 | A1 * | 12/2005 | Amano | A63B 53/0466 473/345 |
| 2009/0111607 | A1 * | 4/2009 | Taylor | A63B 53/04 473/350 |

* cited by examiner

*Primary Examiner* — Sebastiano Passaniti
(74) *Attorney, Agent, or Firm* — Randy K. Chang

(57) ABSTRACT

A heat treated golf club head is disclosed herein. More specifically, the present invention discloses a golf club head wherein the striking face portion and the body portion are heat treated differently to achieve different hardness, strength, and Young's modulus (E) at the two portions to improve the performance of the golf club head.

13 Claims, 9 Drawing Sheets

HEAT TREATED GOLF CLUB

FIELD OF THE INVENTION

The present invention relates generally to a heat treated golf club head. More specifically, the present invention relates to a heat treated golf club head made out of steel. Because steel is an alloy that is very susceptible to changes in material properties during heat treatment, it may be advantageous to take advantage and utilize those changes in material properties in a golf club head to improve the performance. In fact, different portions of the golf club head may be subjected to different heat treatments, ultimately creating a golf club head with different material properties at different locations to meet the different performance needs of the golf club at various locations.

BACKGROUND OF THE INVENTION

Heat treatment is generally used to refer to a process of altering the physical, and sometimes even chemical properties of a material. With respect to metallic materials such as steel, heat treatment can be used to improve the mechanical properties of a material. However, in other examples, a metallic material may even be heat treated to lower the mechanical properties as well.

The application of heat treatment to the golf industry is also known in the art. In fact U.S. Pat. No. 2,332,342 to Reach hinted at heat treating the bottom plate of a golf club head to make it more durable against scuffing all the way back in the 1940's. U.S. Pat. No. 8,663,029 to Beach et al. teaches the utilization of heat treatment on a modern day golf club head by heat treating the cast molten steel or even the cast titanium.

These methodologies, although are very capable of changing the physical properties of the material, do not take advantage of heat treating different portions of the golf club head differently to achieve different performance needs of the golf club head at various portions.

Ultimately, despite all of the attempt to improve the performance of a golf club head via heat treatment; none of the prior art references explore the possibility of heat treating different portions of the golf club head differently to achieve different characteristics. Hence, as it can be seen from above, there is a need in the field for a golf club and a method of heat treatment wherein the ultimate result is capable of creating a golf club with different properties at different portions of the golf club head to match the needs of the golf club head to perform differently at different parts.

BRIEF SUMMARY OF THE INVENTION

One aspect of the present invention is a golf club head comprising of a striking face portion, made out of a first metallic material, located at a frontal portion of the golf club head, and a body portion, made out of a second metallic material, connected to an aft portion of the striking face portion; wherein the striking face portion has been heat treated to a first peak aged condition and the body portion has been heat treated to a second over aged condition. The first peak aged condition is defined as a condition wherein the first material reaches its highest Young's modulus, and the second over aged condition is defined as wherein a Young's modulus of the body portion drops below about 92% of a second peak aged condition of the second material.

In another aspect of the present invention is a golf club head comprising of a striking face portion, made out of a first metallic material, located at a frontal portion of the golf club head, and a body portion, made out of a second metallic material, connected to an aft portion of the striking face portion; wherein the striking face portion has been heat treated to a first peak aged condition and the body portion has been heat treated to a second over aged condition. The first peak aged condition is defined as a condition wherein the first material reaches its highest Rockwell C hardness, and the second over aged condition is defined as wherein a Rockwell C hardness of the body portion drops below about 80% of a second peak aged condition of the second material.

In a further aspect of the present invention is a method of forming a golf club head comprising the steps of heat treating a body portion of the golf club head to an over aged condition, welding a striking face portion to the body portion to create an assembly, and heat treating the assembly until the striking face portion reaches a peak aged condition; wherein the first peak aged condition is defined as a condition wherein the first material reaches its highest Rockwell C hardness, and the second over aged condition is defined as wherein a Rockwell C hardness of the body portion drops below about 80% of a second peak aged condition of the second material.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
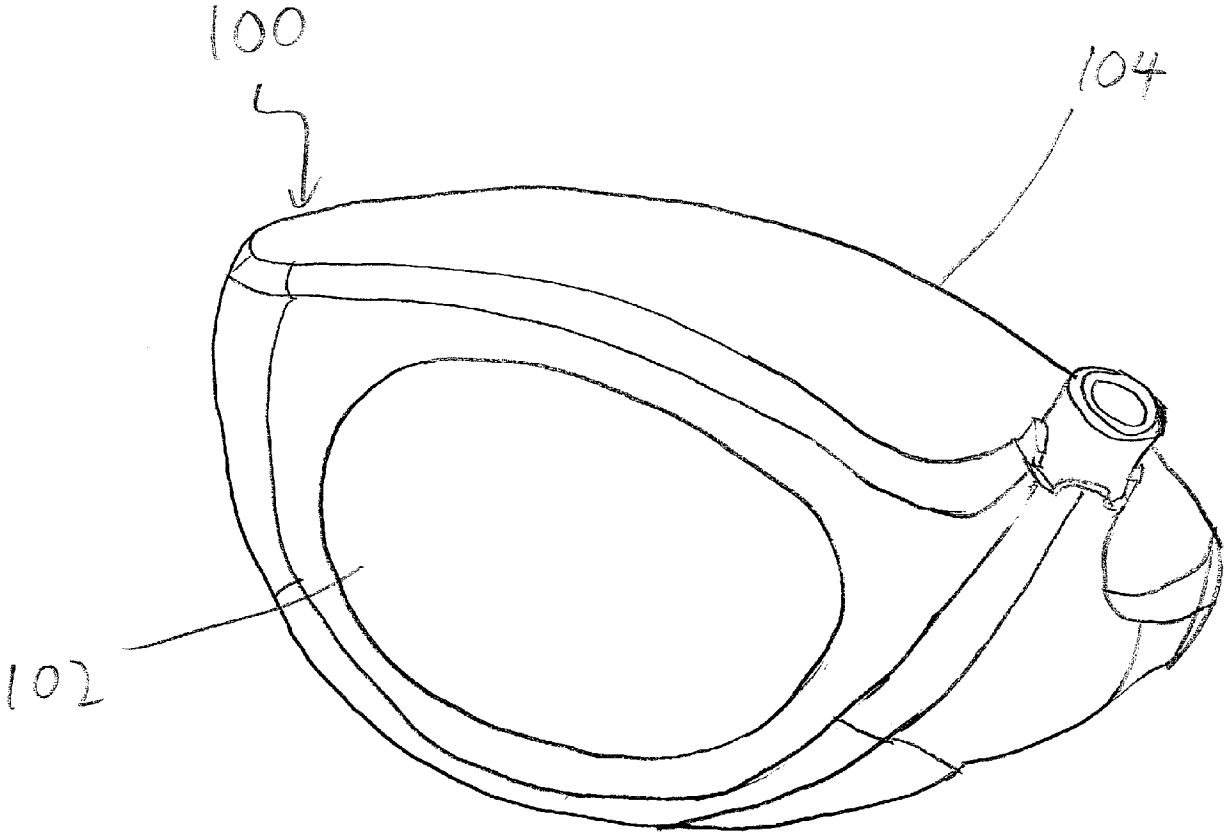
FIG. 1 shows a perspective view of a golf club head in accordance with an exemplary embodiment of the present invention.

FIG. 1 of the accompanying drawings shows a perspective view of a golf club head 100 in accordance with an exemplary embodiment of the present invention. More specifically, golf club head 100 may be further comprised of a striking face portion 102 located at a frontal ball striking region of the golf club head 100, and a body portion 104 attached to the rear of the striking face portion 102 to complete the golf club head 100. As it is commonly known in the industry, the striking face portion 102 of the golf club head 100 generally needs to have high strength and a higher Young's modulus (E) to withstand the impact with a golf ball at high speeds. Alternatively; the body portion 104 of the golf club head 100, due to the fact that it is not subjected to the high stresses of golf ball impact, generally do not require as much strength. In fact, in certain situations, it may even be desirable to have a body portion 104 with a lower Young's modulus (E) to help facilitate the bendability and compliance capabilities of the body portion 104.

Because the current invention utilizes heat treatment to alter the physical properties of the different portions of the golf club head 100, the material used to create the golf club head 100 may generally be a material that is susceptible to phase transformations as a result of heat treatment. In a preferred embodiment, the golf club head 100 may be made out of a steel type alloy material, as steel is generally known to be very susceptible to phase transformation as a result of heat treatment. However, in alternative embodiments of the present invention other types of metallic materials such as titanium, aluminum, tungsten, or any other type of material that is susceptible to phase transformation as a result of heat treatment all without departing from the scope and content of the present invention.

In the current exemplary embodiment both the striking face portion 102 and the body portion 104 of the golf club head may be made out of a 17-4PH steel, as it is one of the materials that exhibits high level of transformation when subjected to heat treatment. However, the material used for the striking face portion 102 does not need to be the same as the material used for the body portion 104, so long as both of the materials can be used to manipulate the hardness, strength, and Young's modulus through heat treatment. In fact, in an alternative embodiment of the present invention, it may be beneficial to use a steel material that exhibits an inherently higher hardness, strength, and Young's modulus for the striking face portion 102 to accentuate the difference between the two portions without departing from the scope and content of the present invention. More specifically, in alternative embodiments of the present invention, the material for the striking face portion 102 may be a custom 450 steel, a custom 455 steel, a custom 465 steel, or even a custom 475 steel while maintaining the usage of a 17-4PH steel for the body portion 102.

Although the names of the material above are generally commonly known in the industry to have a specific definition, it is worthwhile to provide several examples of the chemical composition of these materials to give a clearer understanding of the materials involved. For example, 17-4PH steel, as referred to in the present invention, may generally refer to any steel type material that has approximately 17% chromium, approximately 4% nickel, and approximately 4% copper. In another example, custom 450 steel, as referred to in the present invention, may generally refer to any steel type material that has approximately 15% chromium, approximately 6% nickel, approximately 1.5% copper, and approximately 0.75% molybdenum. Finally, in another example, custom 475 steel, as referred to in the present invention, may generally refer to any steel type material that has approximately 11% chromium, approximately 8% nickel, approximately 0% copper, approximately 8.5% cobalt, approximately 5% molybdenum, and approximately 1% aluminum.

In the current exemplary embodiment of the present invention, in order to achieve the higher hardness, strength, and Young's modulus at the striking face portion 102, the striking face portion 102 is heat treated to a "peak aged" condition. The "peak aged" condition, as defined by the present invention, refers to the condition for which the material achieves its maximum hardness and maximum strength. For 17-4PH steel, the "peak aged" condition is achieved by heat treating the material to approximately 900° F. For Custom 475 steel, the "peak aged" condition is achieved by heat treating the material to approximately 975 to 1,000° F. For Custom 465 steel, the "peak aged" condition is achieved by heat treating the material to approximately 900° F. For Custom 455 steel, the "peak aged" condition is achieved by heat treating the material to approximately 900° F. Finally, for Custom 450 steel, the "peak aged" condition is achieved by heat treating the material to approximately 900° F. As it can be seen from above, different materials require different heat treatments to achieve their "peak aged" condition. However, in the current exemplary embodiment, it can be said that the striking face portion 102 reaches a "peak aged" condition after it has been heat treated to a temperature of between about 900° F. and 1,000° F.

In order to achieve a lower hardness, strength, and Young's modulus, the body portion 104 is heat treated to an "over aged" condition. The "over aged" condition, as defined by the present invention, may generally refer to the condition that a material experiences in losing its hardness and strength after being heat treated beyond their "peak aged" condition. For 17-4PH steel, the "over aged" condition is achieved by heat treating the material to over approximately 1,150° F. For Custom 475 steel, the "over aged" condition is achieved by heat treating the material over approximately 1100° F. For Custom 465 steel, the "over aged" condition is achieved by heat treating the material over approximately 1,100° F. For Custom 455 steel, the "over aged" condition is achieved by heat treating the material over approximately 1,000° F. Finally, for Custom 450 steel, the "over aged" condition is achieved by heat treating the material over approximately 1,150° F. As it can be seen from above, different materials also have different requirements to achieve the "over aged" condition. However, in the current exemplary embodiment, it can be said that the body portion 104 reaches an "over aged" condition after it has been heat treated to a temperature above 1,100° F.

Figure 2:
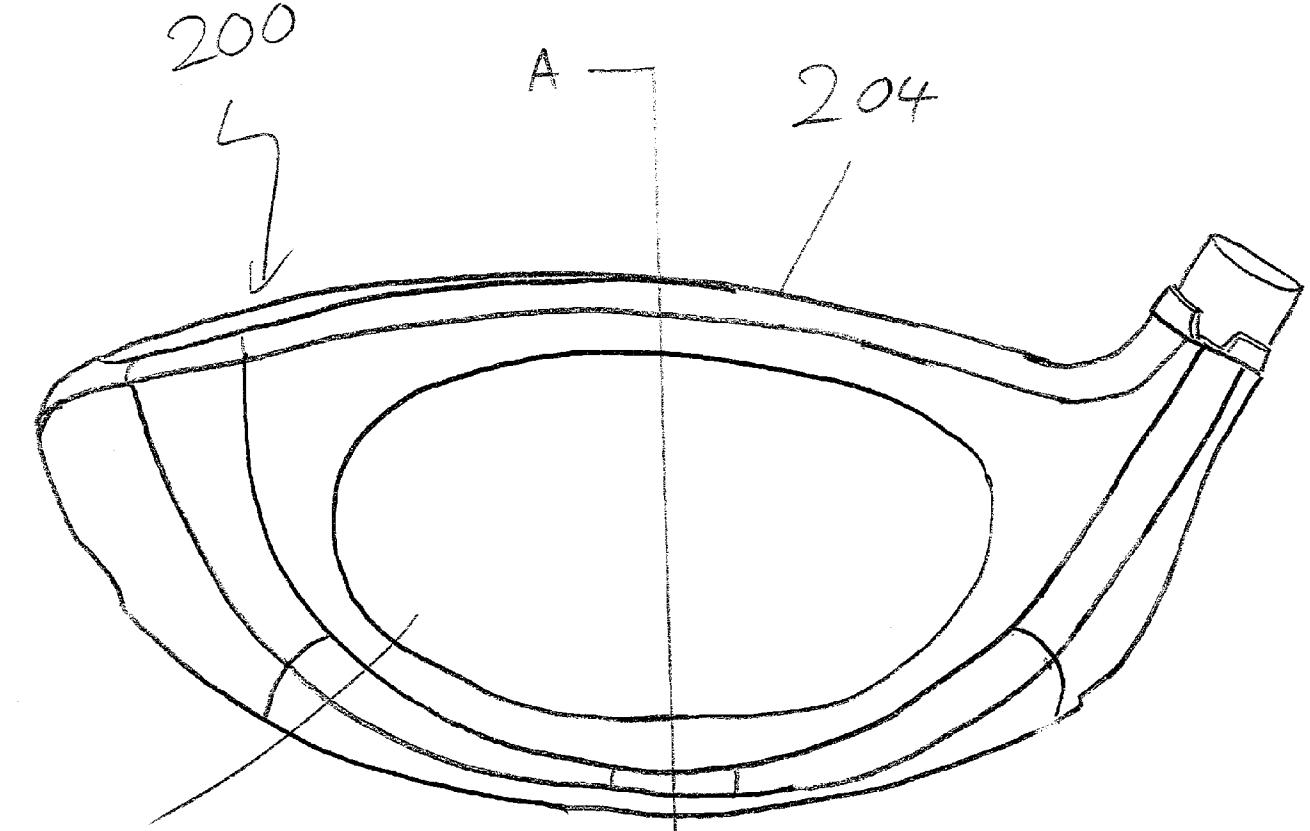
FIG. 2 shows a frontal view of a golf club head in accordance with an exemplary embodiment of the present invention.

FIG. 2 shows a frontal view of a golf club head 200 in accordance with an exemplary embodiment of the present invention. In FIG. 2, not only is the striking face portion 202 shown, the body portion 204 is also shown. Finally, in order to show the internal geometry of the golf club head 200, a cross-sectional line A-A' is provided down the middle of the golf club head 200.

Figure 3:
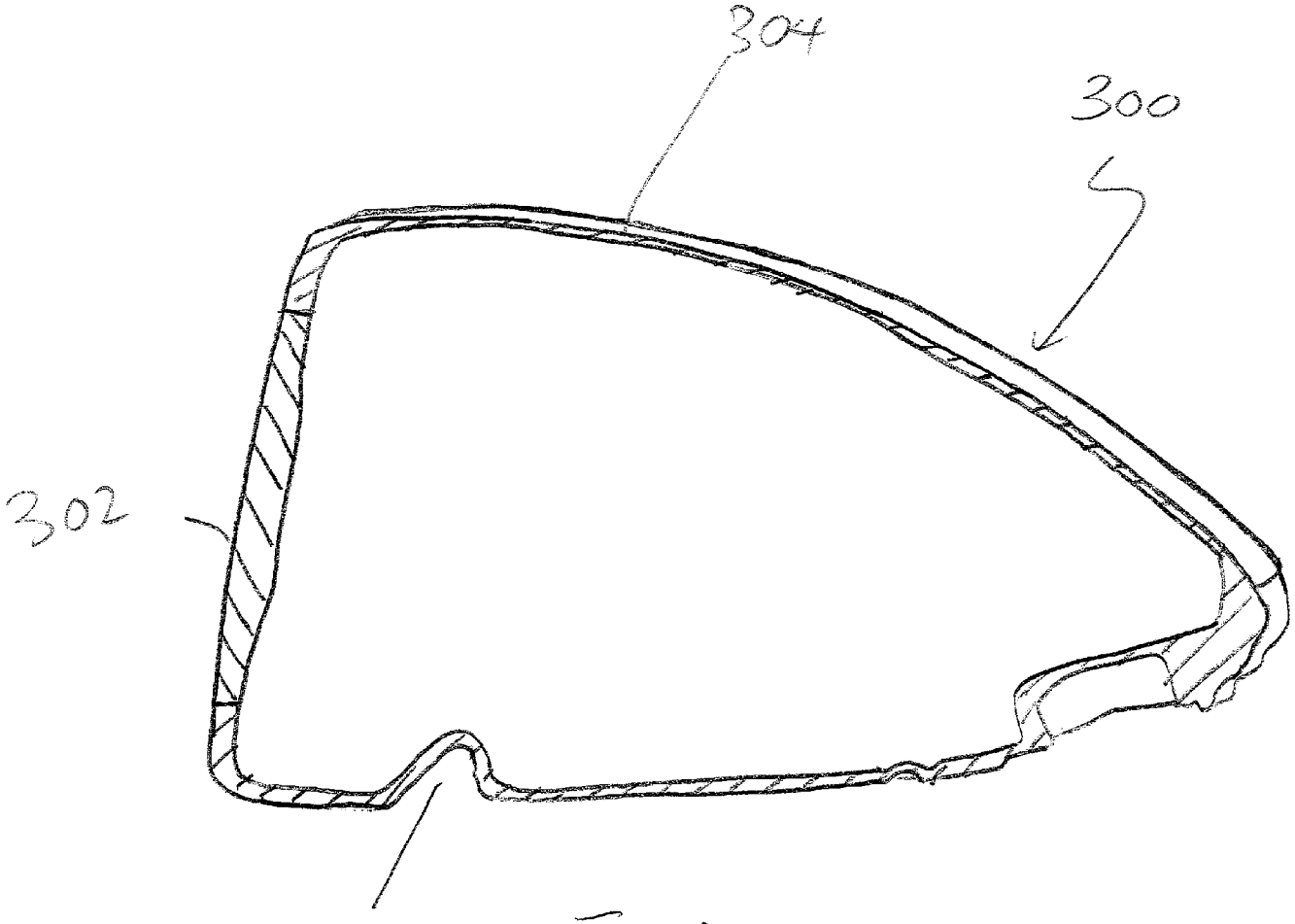
FIG. 3 shows a cross-sectional view of a golf club head along cross-sectional line A-A' as shown in FIG. 2.

FIG. 3 of the accompanying drawings shows a cross-sectional view of a golf club head 300 in accordance with an exemplary embodiment of the present invention taken along cross-sectional line A-A' shown in FIG. 2. In this exemplary embodiment, it can be seen that the sole of the golf club head 300 contains a flexure 306 feature. This flexure 306 feature may generally help the performance of a golf club head 300 by flexing during impact with a golf ball. Thus, it can be seen from the drawings that it is important for the body portion 304 of the golf club head 300 to have a lower strength, hardness, and Young's modulus, thus promoting the compliance of the flexure 306 to improve the performance. Hence, it can be seen from above, it is generally desirable to heat treat the body portion 304 of the golf club head to an "over aged" condition wherein it has a lower Young's modulus when compared to that of the striking face portion 302. Conversely, the striking face portion 302 of the golf club head 300 may generally have a higher strength, hardness, and Young's modulus to make sure it is durable enough to withstand the impact with a golf ball.

Figure 4:
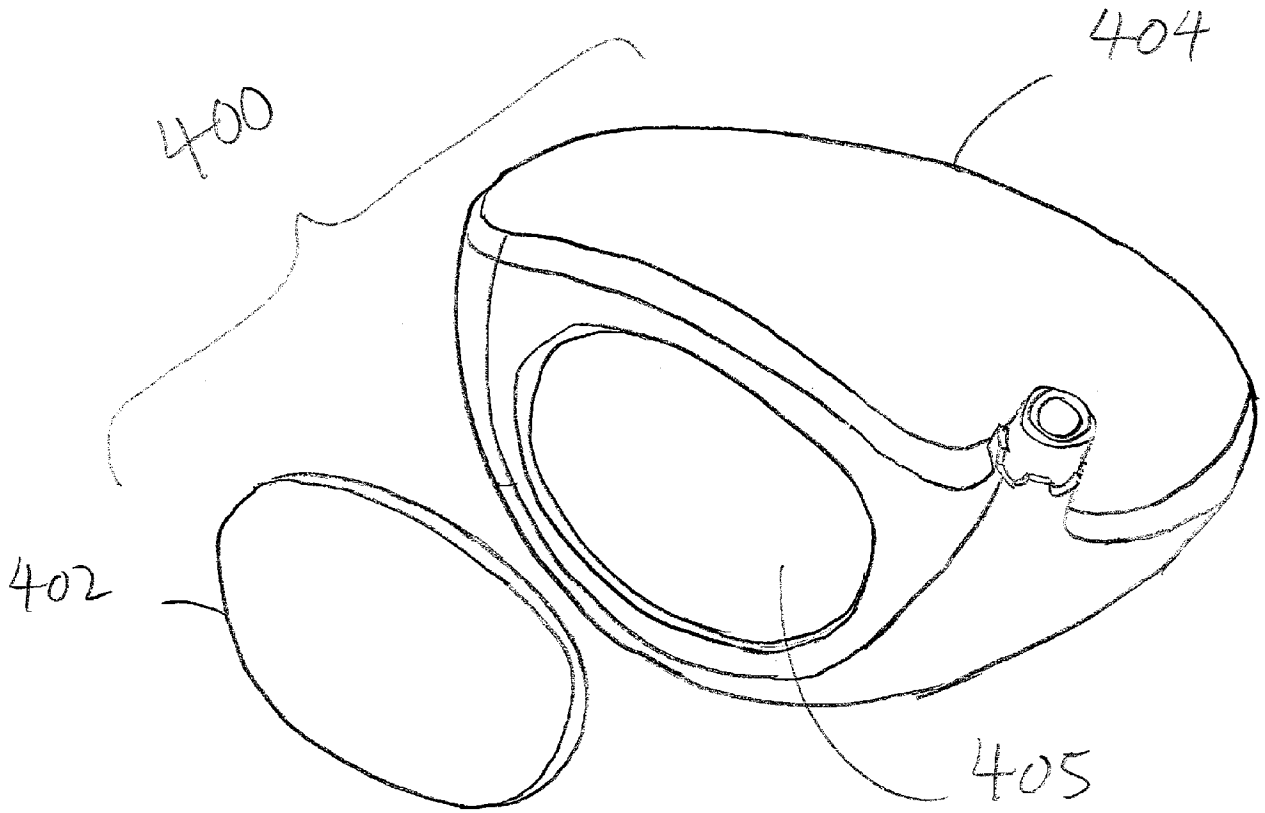
FIG. 4 shows an exploded view of a golf club head in accordance with an exemplary embodiment of the present invention.
Figure 5:
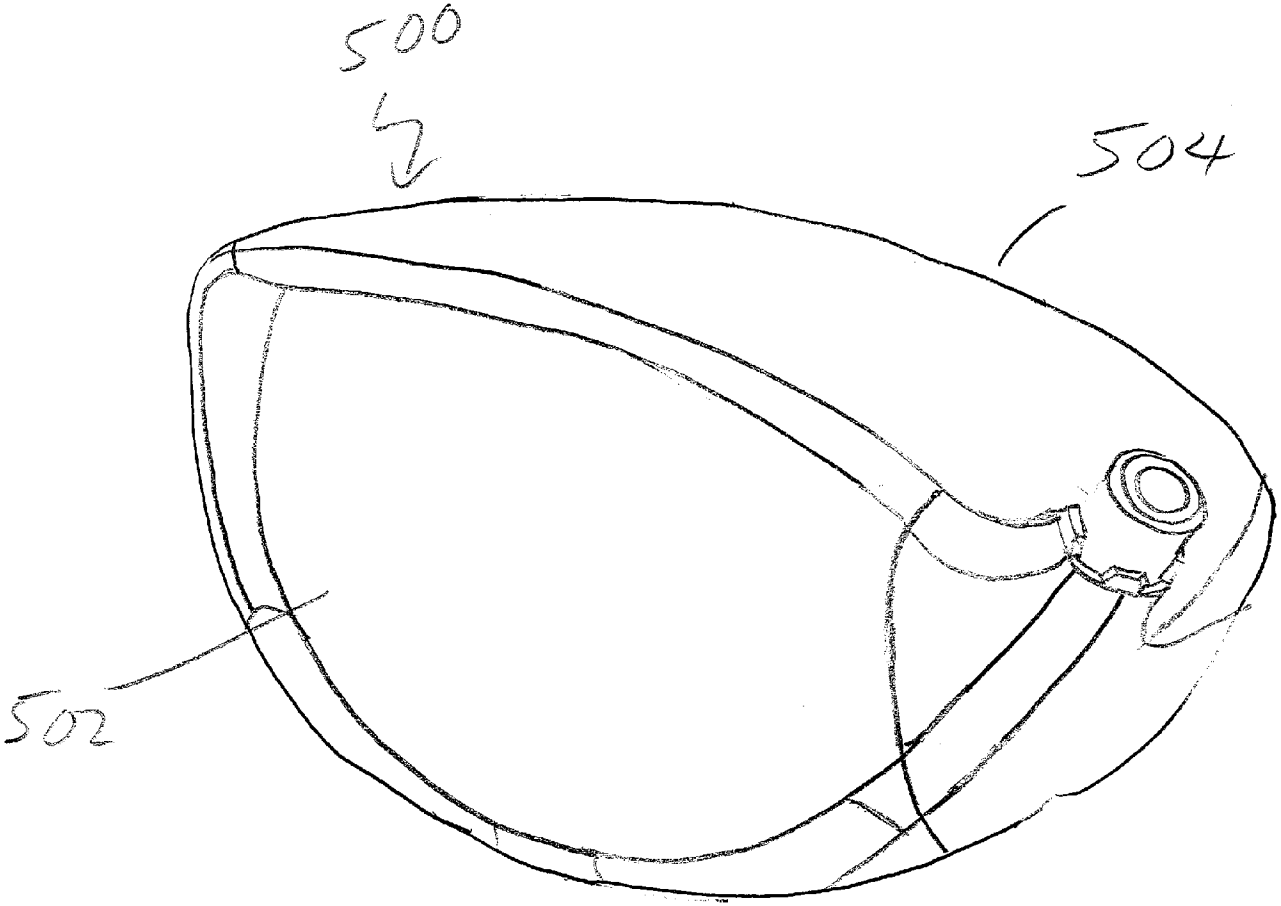
FIG. 5 shows a perspective view of a golf club head in accordance with an alternative embodiment of the present invention.
Figure 6:
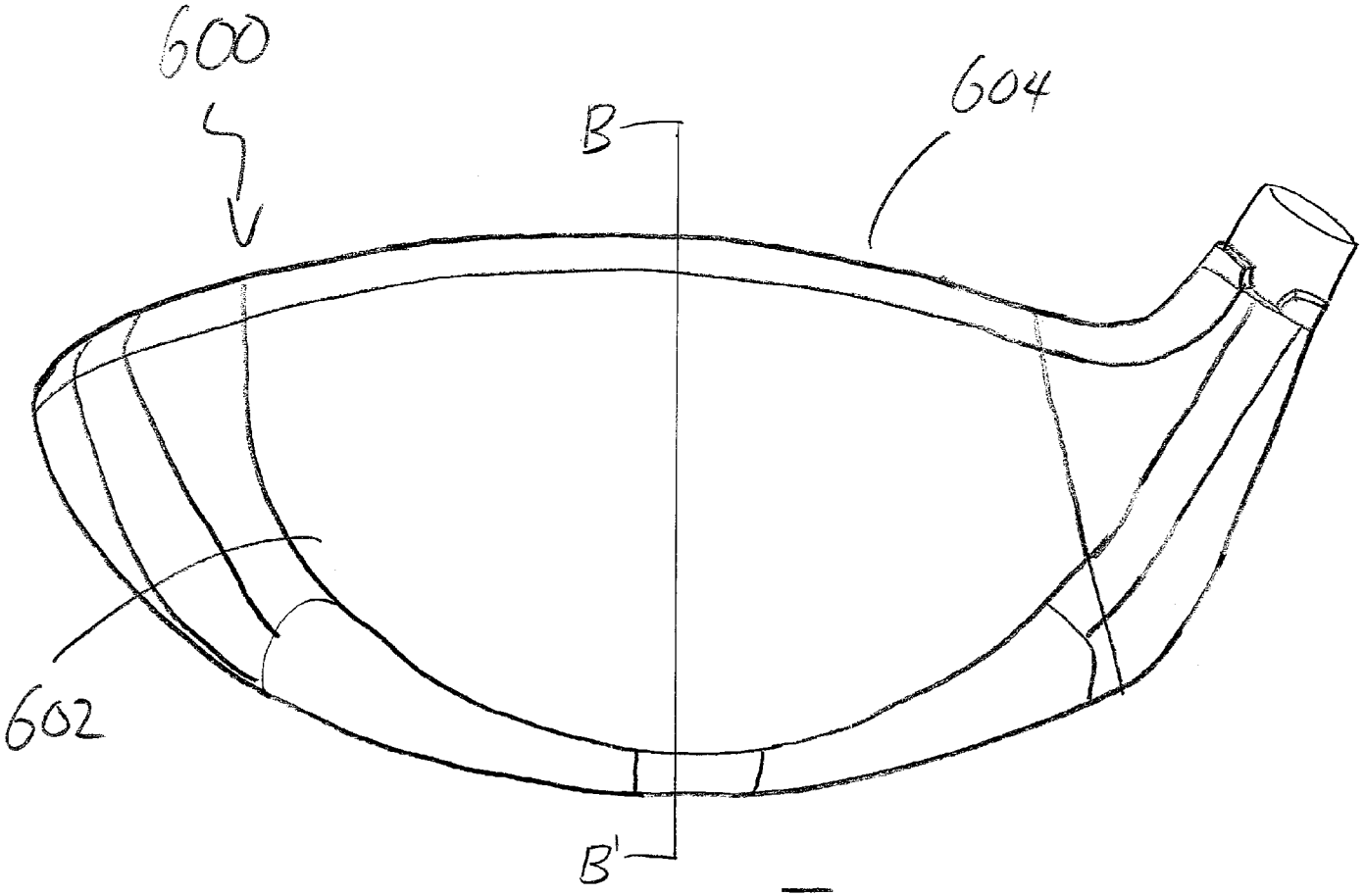
FIG. 6 shows a frontal view of a golf club head in accordance with an alternative embodiment of the present invention.
Figure 7:
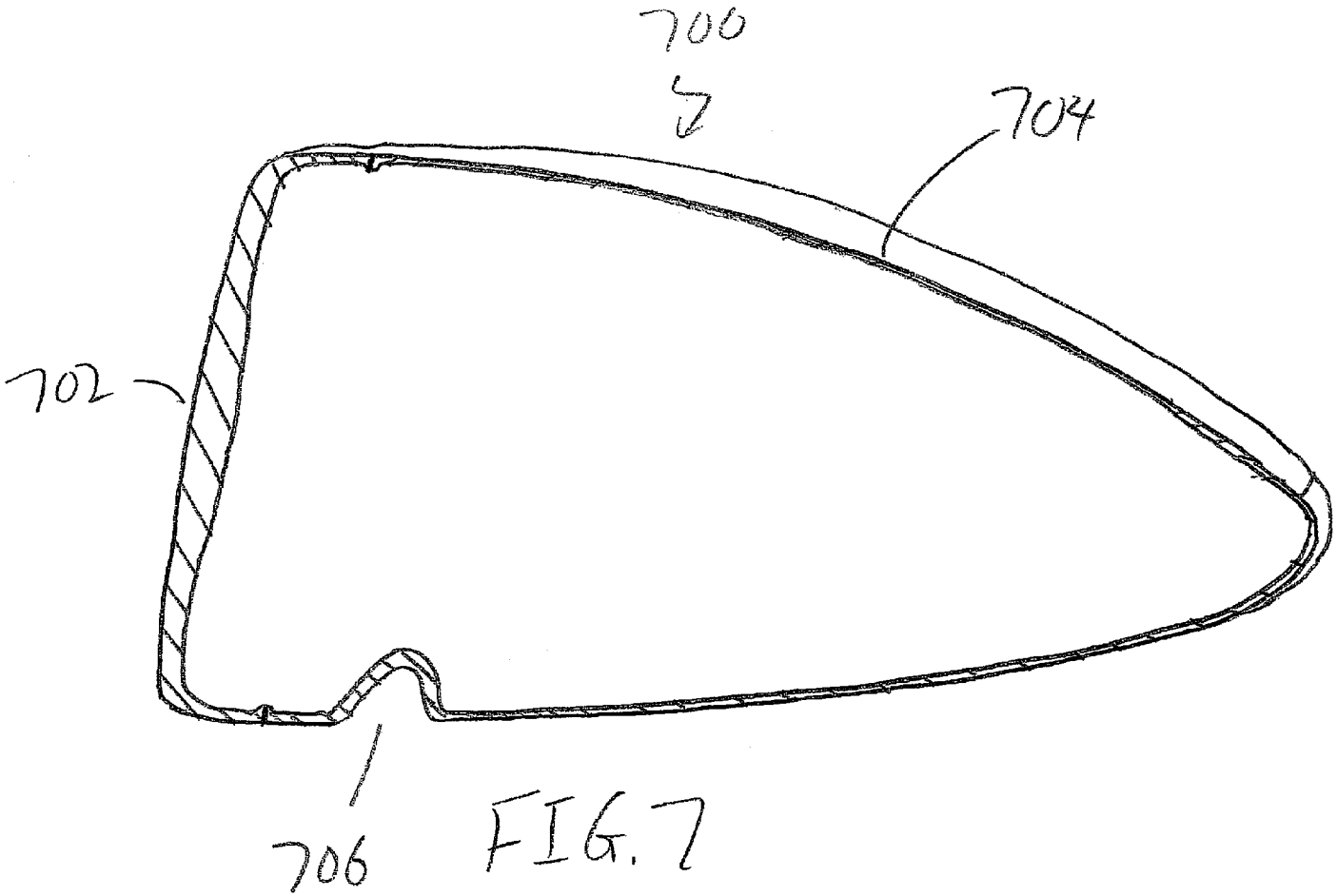
FIG. 7 shows a cross-sectional view of a golf club head along cross-sectional line B-B' as shown in FIG. 6.
Figure 8:
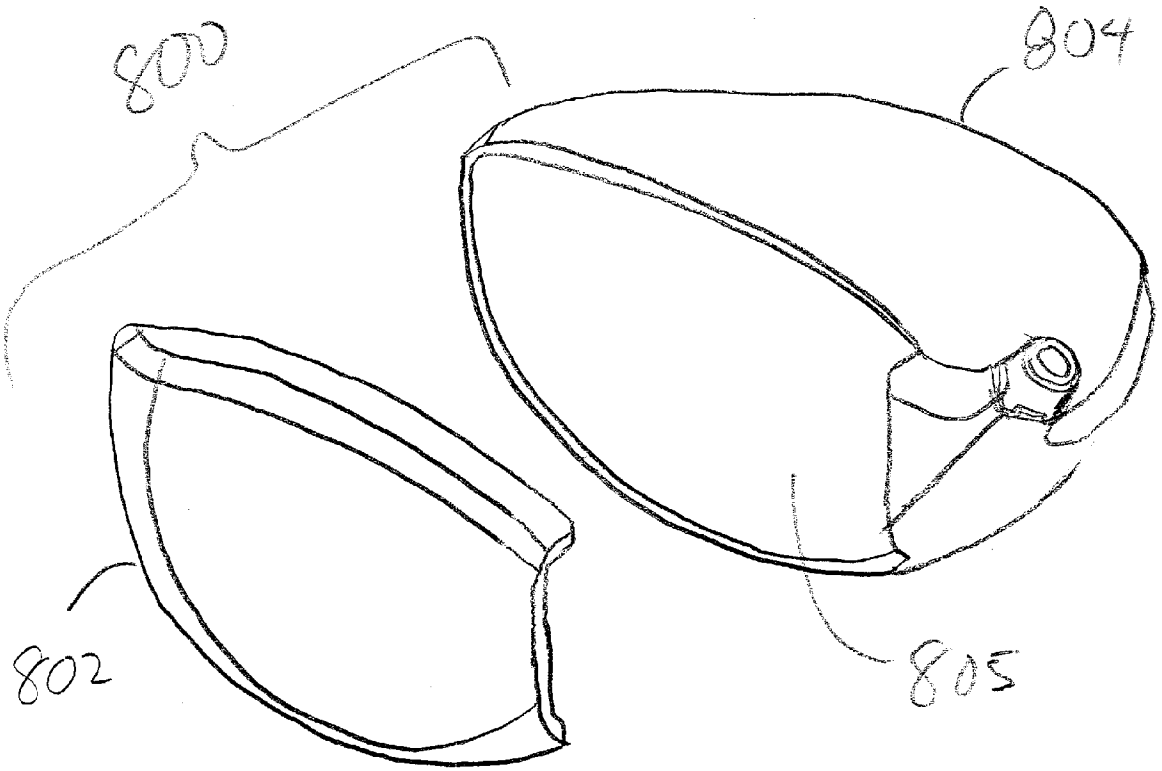
FIG. 8 shows an exploded view of a golf club head in accordance with an alternative embodiment of the present invention.

FIG. 4 of the accompanying drawings shows an exploded view of the golf club head 400 in accordance with this exemplary embodiment of the present invention. The exploded view of the golf club head 400 clearly shows that the current exemplary embodiment of the present invention utilizes a face insert to create the striking face portion 402, adapted to be welded to cover the cavity 405 at the frontal portion of the body portion 404.

FIGS. 5-8 of the accompanying drawings show golf club heads 500, 600, 700, and 800 respectively in accordance with an alternative embodiment of the present invention. These club heads 500, 600, 700, and 800 are similar to the prior embodiment, except that the striking face portion 502, 602, 702 and 802 are formed out of a face cup construction instead of a face insert construction as previously shown. In certain situations, the face cup construction may be preferred over the face insert construction, as it allows the joints to be moved away from the highest stress points of the golf club head; the striking surface.

Figure 9A:
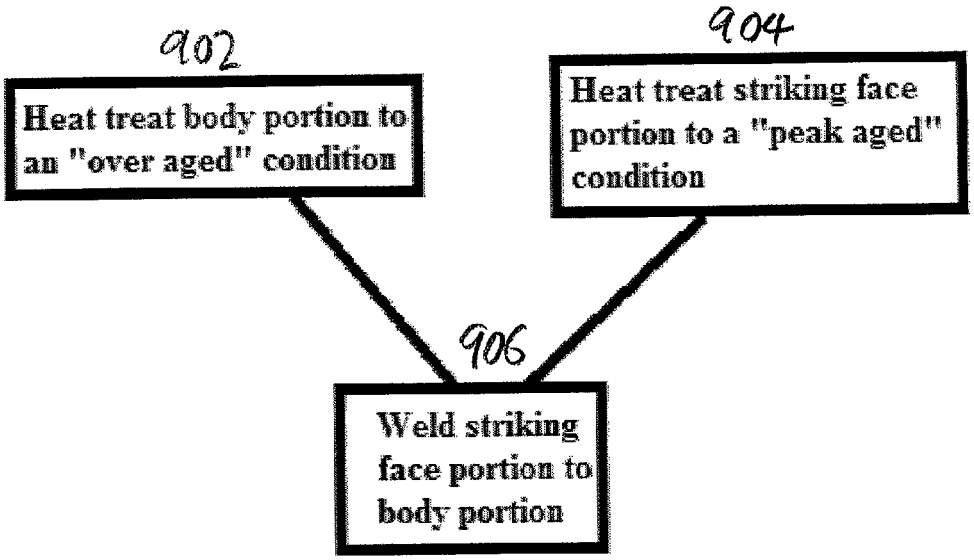
FIG. 9*a* shows a flow chart diagram of a method to create a golf club head in accordance with an exemplary embodiment of the present invention.

FIG. 9*a* shows a flowchart showing the methodology associated with the formation of a golf club head in accordance with the present invention. More specifically, the flowchart in FIG. 9*a* shows one way to create a golf club head that has different Young's modulus at the striking face portion versus the body portion as a result of different heat treatments. In step 902, the body portion is heat treated to an "over aged" condition. As previously mentioned, "over aged" may generally refer to the condition that a material experiences in losing its hardness and strength after being heat treated beyond their "peak aged" condition. In one exemplary embodiment wherein the body portion is made out of 17-4PH steel, the "over aged" condition will yield a hardness of Rockwell C hardness of less than about 33, an ultimate tensile strength of less than about 993 MPa, a 0.2% yield strength of less than about 869 MPa, and a Young's modulus (E) of less than about $24.5*10^3$ ksi. The Young's modulus of the material is generally known as a function of the Modulus of Rigidity (G) of the material at the current condition and material's Poisson's Ratio (v) as shown below in Equation (1).

$$E=2G(1+v) \quad \text{Eq. (1)}$$

In the current exemplary embodiment, the Modulus of Rigidity (G) of the 17-4PH steel at its "over aged" condition is about $10.0*10^3$ ksi, and given that the Poisson's Ratio (v) of the material is 0.272 irrespective of the heat treatment condition, it can be determined that the Young modulus (E) of 17-4PH steel at its "over aged" condition is about $24.5*10^3$ ksi.

In step 904, which can occur independently of step 902, the striking face portion of the golf club head can be heat treated to its "peak aged" condition. The "peak aged" condition of a material, as defined earlier, may generally refer to the condition for which the material achieves its maximum hardness and maximum strength. In the case of 17-4PH steel, the "peak aged" condition will generally yield a material with a hardness of Rockwell C hardness of greater than about 44, an ultimate tensile strength of greater than about 1365 MPa, a 0.2% yield strength of greater than about 1262 MPa, and a Young's modulus (E) of greater than about $25.8\times10^3$ ksi. In alternative embodiments of the present invention, different materials that have high strengths such as Custom 475 Stainless, Custom 465 Stainless, Custom 455 Stainless, or even Custom 450 Stainless may all be used for the striking face portion to further increase the hardness, ultimate tensile strength, 0.2 yield strength, and Young's modulus (E) of the striking face portion above and beyond the capabilities of the basic 17-4PH material without departing from the scope and content of the present invention.

In one alternative embodiment, the striking face portion could be made out of a Custom 475 steel material, yielding an increased ultimate tensile strength of greater than about 1979 MPa, a 0.2% yield strength of greater than 1827 MPa, and a Rockwell C hardness of greater than about 54 without departing from the scope and content of the present invention. Based on the improved strength of this Custom 475 steel material aged to its "peak aged" condition, it can be seen that a greater gradient difference between the striking face portion and the body portion can be achieved as previously stated.

Based on the relative Young's modulus (E) of the 17-4PH steel above in its "peak aged" and "over aged" condition, one can see a special relationship between the two conditions. Hence, it can be said that an "over aged" condition may generally be defined as a condition during which the hardness of the material decreases to a point that is below about 80% of the "peak aged" condition hardness, more preferably less than about 77.5% of the "peak aged" condition hardness, and most preferably less than about 75% of the "peak aged" condition Rockwell C hardness. In addition to the above, "over aged" condition can also be defined as a condition during which the ultimate tensile strength of the material decreases to a point that is below about 80%, more preferably less than about 77.5%, and most preferably less than about 75 of the "peak aged" condition ultimate tensile strength. Similarly, the "over aged" condition can also be defined as a condition during which the 0.2% yield strength deceases to a point that is below about 80%, more preferably less than about 77.5%, and most preferably less than about 75 of the "peak aged" condition 0.2% yield strength.

However, when it comes to the Young's modulus (E) of the material, the ratio that defines the difference between "over aged" and "peak aged" conditions are slightly different. More specifically, "over aged", as defined by the present invention, relates to when the Young's modulus (E) of the material decreases below about 92% of the "peak aged" condition, more preferably below about 91% of the "peak aged" condition, and most preferably below about 90% of the "peak aged" condition.

Once the body portion and the striking face portion have all been heat treated to their respective desired heat treatment condition, then in step 906 is when the two components are welded together. It should be noted that when the two metallic materials are joined together in a welding process, the portion that is near the welding region can often be subjected to extremely high temperature that far exceeds the "peak aged" or even the "over aged" condition temperatures. This extremely high temperature can jeopardize and even destroy the desired strength of the different portions; resulting in portions of the joint that are unpredictable in terms of the Young's modulus (E). In order to address this issue, it may be desirable to utilize a golf club head that has a face cup construction, as shown in FIGS. 5-8, instead of the face insert type construction, as shown in FIGS. 1-4 allowing the joint regions to be moved away from the impact surface of the golf club head.

Figure 9B:
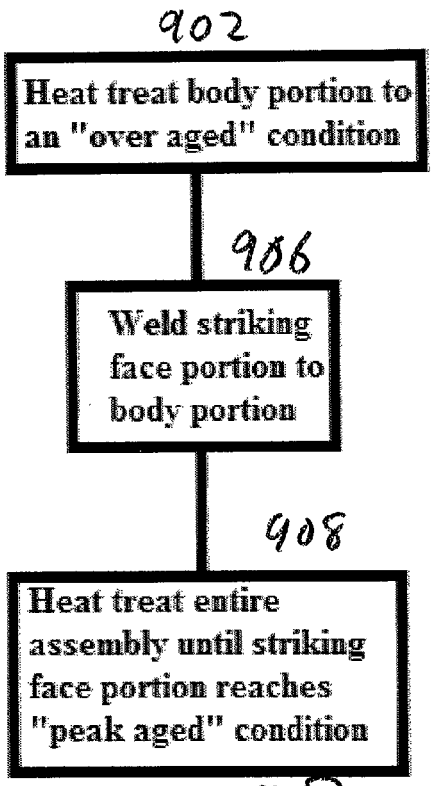
FIG. 9*b* shows a flow chart diagram of a method to create a golf club head in accordance with an alternative embodiment of the present invention.

FIG. 9B shows a flowchart showing the methodology associated with the formation of a golf club head in accordance with an alternative embodiment of the present invention. Although the procedures are very similar to the embodiment of the present invention described in FIG. 9A, the sequencing of the heat treatment makes a dramatic difference and should be highlighted below. In step 902, similar to previously discussed, the body portion is heat treated to an "over aged" condition. This "over aged" condition, as defined above, may generally be defined as a condition that yields a Young's modulus (E) of less than about 92% of the "peak aged" condition's Young's modulus (E), more preferably less than about 91%, and most preferably less than about 90%.

Once the body portion is heat treated to an "over aged" condition, this alternative embodiment of the present invention proceeds with welding this "over aged" body portion to a un-heat treated striking face portion in step 906. Once the entire golf club head is created, then the entirety of the assembly is heat treated until the striking face portion reaches a "peak aged" condition in step 908. It should be noted that in this current alternative embodiment, the body portion has been heat treated twice, once to its "over aged" condition before it is welded to the striking face; and another time until the striking face portion reaches its "peaked aged" condition. However, in this scenario, when the body portion is treated the second time, it does not alter the material property of the body portion. This happens because when a material has already been heat treated to its "over aged" condition by heating it to approximately 1150° F., any subsequent heat treatment that falls short of that temperature range should not affect the material property of that material. Hence, when the entirety of the assembly, including the body portion, is heat treated to the "peak aged" condition temperature of the striking face of approximately 900° F.; it should not adversely affect the desired Young's modulus (E) of the body portion.

This alternative embodiment allows the welding joints between the striking face portion and the body portion to preserve its Young's modulus, as the material is heat treated after it has been welded together. This alternative embodiment of the present invention may be more suitable for a face insert type construction, as shown in FIGS. 1-4, as the degradation of the strength of the striking face is minimized via the heat treatment process described in FIG. 9.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion, made out of a first metallic material, located at a frontal portion of said golf club head; and a body portion, made out of a second metallic material, connected to an aft portion of said striking face portion, wherein said striking face portion has been heat treated to a first peak aged condition and said body portion has been heat treated to a second over aged condition;

said first peak aged condition defined as a condition wherein said first material reaches its highest Young's modules, and said second over aged condition is when a Young's modulus of said body portion drops below about 92% of a second peak aged condition of said second material.

2. The golf club head of claim 1, wherein said second over aged condition is when a Young's modulus of said body portion drops below about 91% of said second peak aged condition of said second material.

3. The golf club head of claim 2, wherein said second over aged condition is when a Young's modulus of said body portion drops below about 90% of said second peak aged condition of said second material.

4. The golf club head of claim 1, wherein said first material is the same as said second material.

5. The golf club head of claim 1, wherein said first material is different from said second material.

6. The golf club head of claim 5, wherein said second material is a 17-4 PH steel material.

7. The golf club head of claim 5, wherein said 17-4-PH steel has a Rockwell C hardness less than about 33, an ultimate tensile strength of less than about 993 MPa, a 0.2% yield strength of less than about 869 MPa, and a Young's modulus of less than about $24.5*10^3$ ksi.

8. A golf club head comprising:

a striking face portion, made out of a first metallic material, located at a frontal portion of said golf club head; and a body portion, made out of a second metallic material, connected to an aft portion of said striking face portion, wherein said striking face portion has been heat treated to a first peak aged condition and said body portion has been heat treated to a second over aged condition;

said first peak aged condition defined as a condition wherein said first material reaches its highest Rockwell C hardness, and said second over aged condition is when a Rockwell C hardness of said body portion drops below about 80% of a second peak aged condition of said second material.

9. The golf club head of claim 8, wherein said second over aged condition is when a Rockwell C hardness of said body portion drops below about 77.5% of a second peak aged conditions of said second material.

10. The golf club head of claim 9, wherein said second over aged condition is when a Rockwell C hardness of said body portion drops below about 75% of a second peak aged conditions of said second material.

11. The golf club head of claim 10, wherein said striking face portion is a face insert.

12. The golf club head of claim 10, wherein said striking face portion is a face cup.

13. The golf club head of claim 10, wherein said first material is different from said second material.

* * * * *